United States Patent [19]

Richard

[11] Patent Number: 4,648,223

[45] Date of Patent: Mar. 10, 1987

[54] CONCRETE STRUCTURE, BLOCK FOR MAKING SUCH STRUCTURE AND METHOD OF MAKING SUCH STRUCTURE

[75] Inventor: Pierre Richard, Neuilly, France

[73] Assignee: Bouygues, Clamart, France

[21] Appl. No.: 680,545

[22] Filed: Dec. 11, 1984

[30] Foreign Application Priority Data

Dec. 14, 1983 [FR] France ..... 83 20092

[51] Int. Cl.[4] ..... E04G 7/20

[52] U.S. Cl. ..... 52/223 R; 52/227; 52/648; 52/650; 52/DIG. 10; 403/171; 403/217; 403/265; 405/195

[58] Field of Search ..... 52/648, 650, 651, DIG. 10, 52/223 R, 227, 655, 693, 726; 403/171-178, 217, 218, 292, 293, 265, 266; 405/195

[56] References Cited

U.S. PATENT DOCUMENTS

| | | | |
|---|---|---|---|
| 954,283 | 4/1910 | Hawkes . | |
| 1,425,114 | 8/1922 | Luard . | |
| 2,653,451 | 9/1953 | McCullouch . | |
| 2,970,388 | 2/1961 | Yonkers | 52/DIG. 10 |
| 3,083,793 | 4/1963 | Brout | 52/648 X |
| 3,284,113 | 11/1966 | Howell | 403/265 X |
| 3,343,324 | 9/1967 | Gordon . | |
| 3,382,625 | 5/1968 | Kuss | 52/223 R X |
| 3,452,452 | 7/1969 | Dore | 403/292 X |
| 3,466,823 | 9/1969 | Dowling | 52/227 |
| 3,722,153 | 3/1973 | Baer . | |
| 3,864,049 | 2/1975 | Ono | 52/648 X |
| 4,059,931 | 11/1977 | Mongan | 52/227 X |
| 4,074,497 | 2/1978 | Ono | 52/648 |
| 4,161,088 | 7/1979 | Gugliotta et al. | 52/223 R |
| 4,189,252 | 2/1980 | Inman . | |
| 4,426,173 | 1/1984 | Richart et al. . | |
| 4,504,172 | 3/1985 | Clinton et al. . | |

*Primary Examiner*—William F. Pate, III
*Assistant Examiner*—R. Chilcot, Jr.
*Attorney, Agent, or Firm*—Fleit, Jacobson, Cohn & Price

[57] ABSTRACT

A concrete structure including a rigid three-dimensional lattice of concrete bars which are interconnected at nodes. The lattice is constituted by an assembly of prefabricated cast blocks, in which each block comprises a node and a plurality of arms (14) radiating from the node. Each arm has at least one longitudinal socket with an opening in the free end of the arm, and the arms of two blocks are assembled in aligned end-to-end pairs to constitute the bars of the lattice. The sockets of assembled arms are in alignment and contain a common metal reinforcing member, and the junction zone of the arms is surrounded by a clamping sleeve, with said sockets being filled with hardened mortar. The said lattice is prestressed by prestress cables passing outside the bars of the lattice and fixed to some nodes of the lattice.

11 Claims, 10 Drawing Figures

CONCRETE STRUCTURE, BLOCK FOR MAKING SUCH STRUCTURE AND METHOD OF MAKING SUCH STRUCTURE

The present invention relates to concrete structures. An object of the invention is to provide a concrete structure suitable for constituting a ballastable base for an offshore platform.

Another object of the invention is to provide a concrete structure suitable for constituting a weight-carrying three-dimensional lattice.

BACKGROUND OF THE INVENTION

Ballastable concrete bases for offshore platforms are known which are constituted by solid concrete walls. These bases may be suitable for use in cold seas since they are strong enough to resist the pressure of ice, which may be very high, but they suffer from the drawback of being very heavy. Attempts have been made to lighten them by using lightweight concrete, but this solution is expensive and not entirely satisfactory.

Preferred embodiments of the present invention provide a base which may be made from normal concrete, which has high strength, and which is nevertheless of reasonable weight.

SUMMARY OF THE INVENTION

The base of the present invention is essentially constituted by a volume formed from a rigid three-dimensional lattice of concrete bars which are assembled in concrete nodes, some of the nodes being interconnected by cables which pass outside the bars and which may pass intermediate nodes, said cables providing three-dimensional prestressing for the lattice assembly as a whole, the base including means for making waterproof the sides and the bottom of the lattice.

The concept of a three-dimensional concrete lattice is known, but up to the present, such a lattice has not been used for the specific application outlined above in combination with prestressing cables for the lattice as a whole and in combination with waterproof sides and bottom.

Further, up to the present, there has not been a known industrial technique enabling a concrete lattice to be made under acceptable conditions, and one aim of the invention is also to provide such a technique and to apply it not only to the fabrication of a platform base, but also to any other structure.

In accordance with the invention, the lattice is constituted from an assembly of blocks which are prefabricated by molding, each block comprising a node and a plurality of arms radiating from the node, each arm having at least one longitudinal socket open at the free end of the arm, with arms being assembled in aligned pairs to constitute the bars of the lattice, the sockets of an assembled pair of arms being aligned and receiving a common metal reinforcing member, the junction zone between the assembled arms being surrounded by a sealing sleeve, the said sockets being filled with hardened mortar, and the said lattice being clamped by prestress cables which pass outside the bars of the lattice and which are fixed to same nodes of the lattice.

BRIEF DESCRIPTION OF THE DRAWINGS

Embodiments of the invention are described by way of example with reference to the accompanying drawings, in which:

FIG. 18 is a perspective view of a further embodiment of a prefabricated block in accordance with the invention;

DESCRIPTION OF THE PREFERRED EMBODIMENTS

Figure 1:
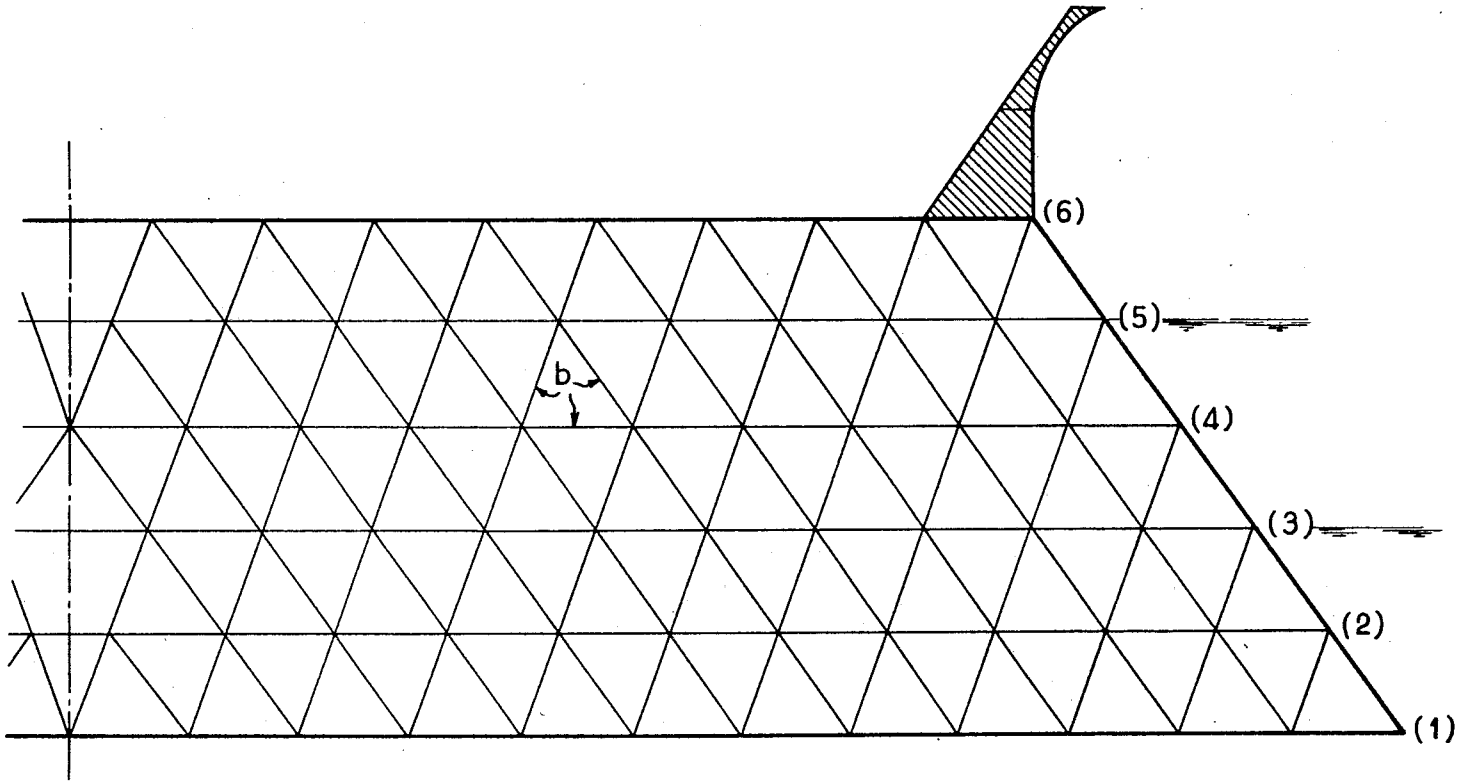
FIG. 1 is a vertical half-section through a platform base in accordance with the invention.
Figure 2:
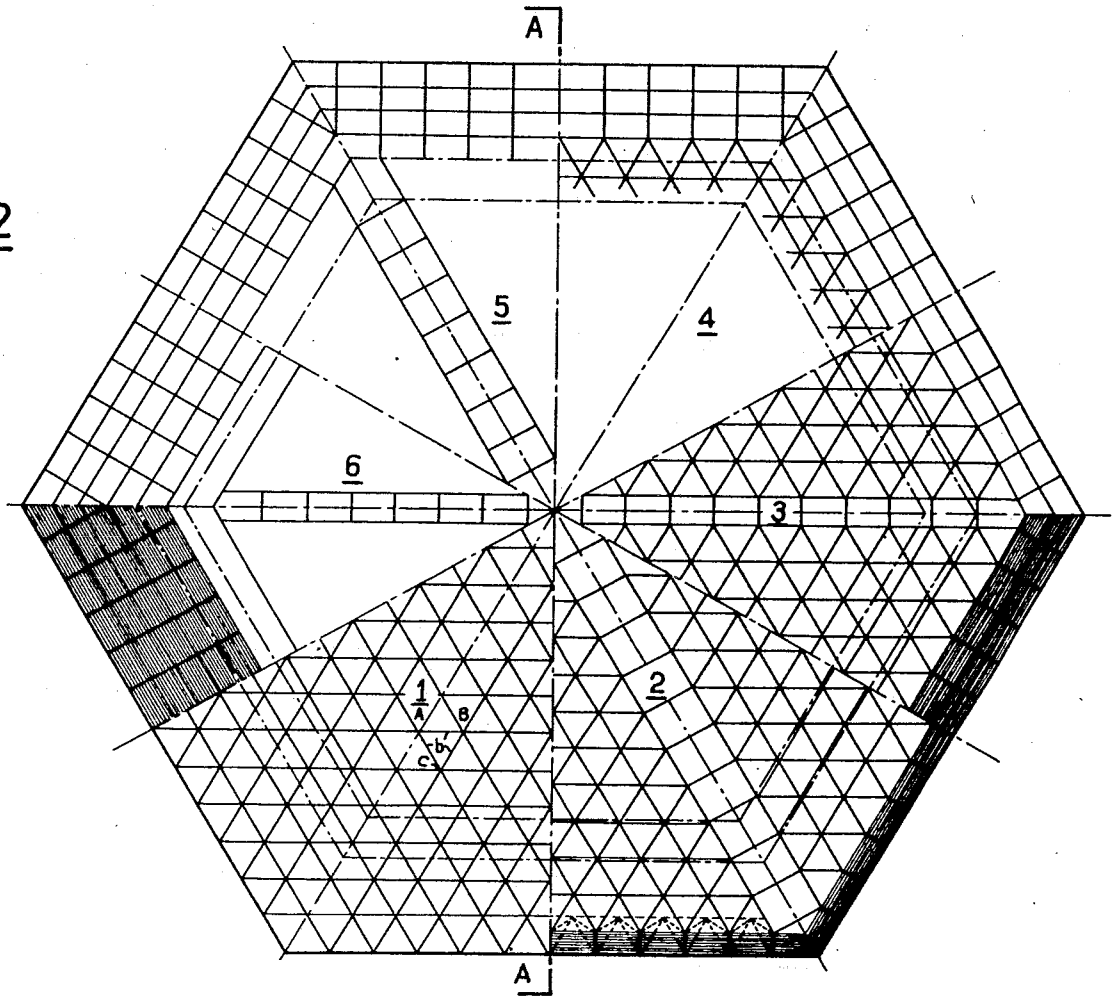
FIG. 2 is a set of horizontal sections through the base on planes at different levels.

The platform base shown in FIGS. 1 and 2 is a hexagonal base having a side of 72 meters (m). The base is constituted by a lattice which is provided with means for making watertight the lateral sides and the bottom of the lattice. In accordance with the invention, the lattice is constituted by concrete bars which are assembled at concrete nodes. The sides and the bottom of the lattice are provided with the walls for making them watertight.

In a preferred embodiment, the lattice is an assembly of regular tetrahedra, with the nodes being constituted by the vertices of the tetrahedra and the bars being disposed along the sides of the tetrahedra.

In this assembly of tetrahedra, there are inclined planes in which the bars form a mosaic of equilateral triangles and inclined planes in which the bars form a mosaic of squares or rectangles. There are also horizontal planes in which the bars form a mosaic of equilateral triangles.

In the embodiment shown the bars of the lattice form squares in planes inclined at 50° to 60°, they form equilateral triangles in planes inclined at 65° to 75°, and they form equilateral triangles in horizontal planes.

Preferably, the lateral sides of the lattice comprise planes in which the bars form equilateral or isoscele triangles alternating with planes in which the bars for squares or rectangles.

The plane of the section in FIG. 1 is a vertical plane and the figure shows one half of the section plane.

FIG. 2 shows a plurality of horizontal section planes. FIG. 2 is thus divided into six portion each representing a fraction of a horizontal section at a different level. For example, reference numerals 1, 2, 3, 4, 5, and 6 represent sectons at levels which are approximately at 0 m, 5 m, 10 m, 15 m, 20 m, and 25 m respectively. In the fraction of the figure representing the m level section plane, it can be seen that the bottom plane of the lattice is constituted by a mosaic of equilateral triangles A, B, C whose sides are constituted by bars of the lattice and whose vertices are constituted by nodes of the lattice. A part of the fraction of the figure relating to the level of about +5 m, is shaded to show the portion of the lateral facade which extends below the plane of the section.

Similar shading is to be found on the fractions representing sections at about +10 m and about +25 m.

The section of FIG. 1 is taken on a plane marked A—A in FIG. 2.

The lattice may be made by any suitable method, but is preferably made by the following method.

In this technique in accordance with the invention, blocks are injection molded in closed molds, which blocks comprise a central node and arms which radiate from the node. The node is intended to become one of the nodes of the lattice, and each arm is intended to constitute a portion of a lattice bar.

The arms are assembled in pairs with an arm from one block being disposed end-to-end with an arm from another block thereby constituting one bar of the lattice. The lattice is built up piece-by-piece in this manner. In a preferred embodiment, a portion of the bottom level of the lattice is made first, then the next level portion, and so on up to the top level portion, with block positioning devices running on the ground just ahead of where assembly is being performed. Each level is thus built up piece-by-piece.

It may be observed that the blocks may be prefabricated in a workshop, which is particularly advantageous for ballastable offshore platforms which usually have to be built in dry dock.

The invention enables a large portion of the work to be performed away from the dry dock, since only the actual assembly of the blocks needs to be done in the dry dock.

Any suitable means may be used to assemble two arms, and preferably the arms are prefabricated with respective sockets with openings in their end faces which coincide when the arms are placed end-to-end. Each socket is additionally provided with a passage enabling mortar to be inserted therein or enabling air to be evacuated therefrom. For assembly, a common reinforcing manner is placed in the two sockets, a sealing sleeve is placed around the junction between the two arms and mortar is inserted into the sockets and is allowed to set therein.

The sleeve is preferably made of heatshrink material.

It may be observed that the mortar which fills the sockets may constitute a pad of greater or lesser thickness between the end faces of the arms. The position of each new mode to be added to the structure can thus be accurately adjusted by injecting mortar to move the end faces of the arms apart, jacklike. The mortar then sets leaving a pad J of just the wanted thickness. It is thus easy to ensure that each node is correctly positioned during assembly, and this constitutes an important advantage of the method of the invention.

Figure 4:
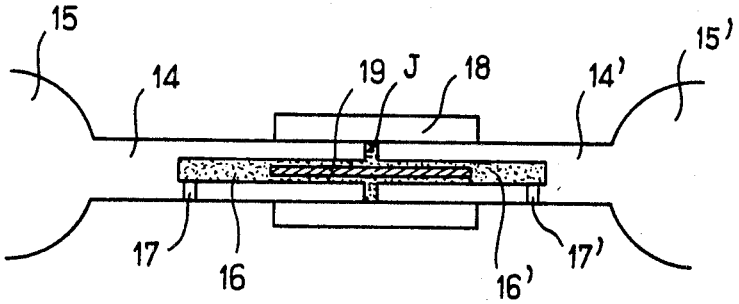
FIG. 4 is a diagram showing how two portions of a bar are assembled to build up a bar of the lattice.

FIG. 4 is a diagram for explaining the technique of assembling two arms, as described above. In this diagram the arms are referenced 14 and 14', the corresponding nodes 15 and 15', the corresponding sockets 16 and 16', their passage 17 and 17', the sleeve is referenced 18 and the reinforcing member 19.

In a typical example, the arms are rods having a right cross section that can be inscribed in a circle of 20 cm to 100 cm diameter, and the bars are 2 m to 10 m long. The rods are preferably of circular section with a diameter in the range 30 cm to 80 cm, and the bars are preferably assembled using a mortar capable of withstanding high compression at pressures of up to 600 to 1000 bars.

Each arm preferably constitutes one half of a bar.

This preferred choice is not essential, and the arms could constitute fractions other one half of a bar in variant embodiments, however, the choice of one half makes for highly rationalized construction.

Further, two arms could be interconnected by an intermediate member rather than being directly interconnected. For example, if each arm constitutes one third of a bar, two arms would be interconnected by means of an intermediate member constituting the middle third of the bar.

The overall lattice is clamped by cables which provide three-dimensional prestressing. The cables are fixed at their ends to nodes of the lattice.

In a typical example, a given cable will repeatedly pass lattice bars which in crosses substantially in the middle and orthogonally, interspersed by lattice nodes which it also passes.

Figure 3:
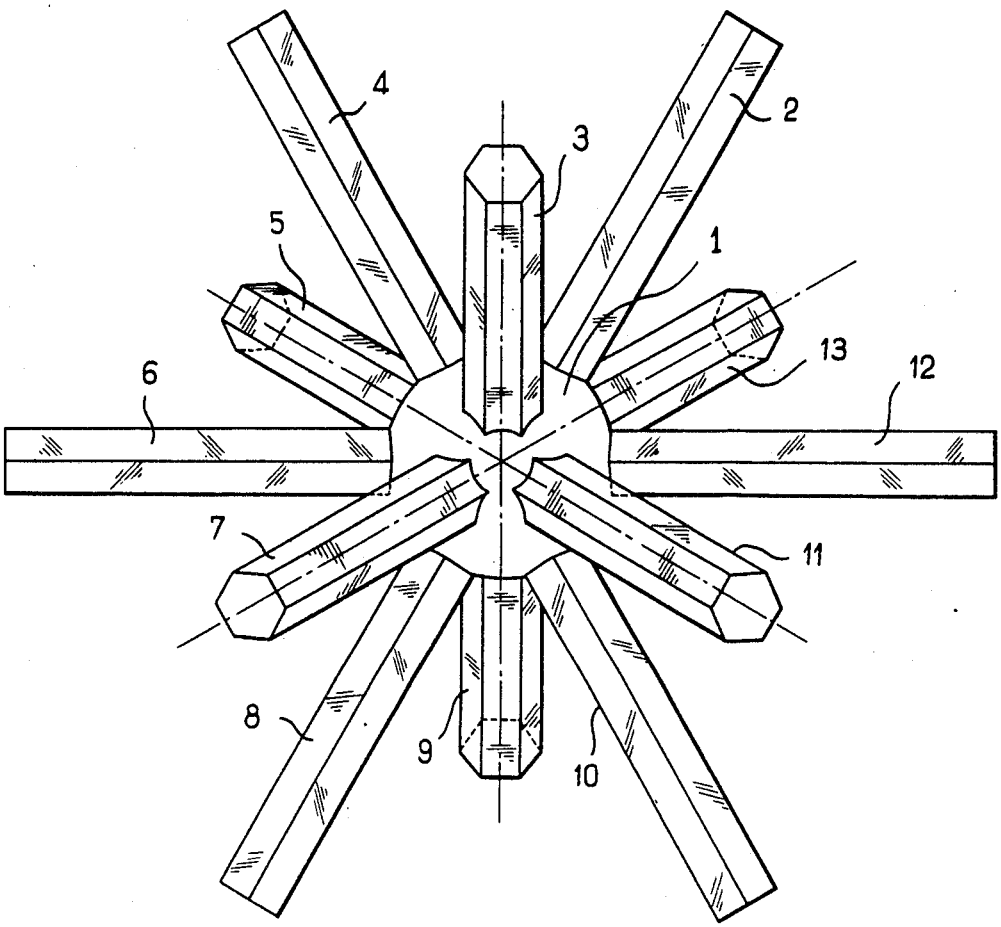
FIG. 3 is a perspective view of a component block for the base lattice.

FIG. 3 is a perspective view of a single block given by way of example and constituting a node 1 from which 12 arms (2–13) radiate, with each arm being intended to constitute one half of a lattice bar.

Thus, in the lattice of FIGS. 1 and 2, there are eight-arm blocks, nine-arm blocks and twelve-arm blocks.

Naturally, it will readily be understood that the blocks situated in the outside planes of the lattice, ie. in the planes which constitute the bottom, the sides and the top of the lattice, have fewer arms.

The base is additionally provided with a watertight bottom and with a watertight facade.

The watertight bottom is preferably constituted by a mosaic of pyramides thus enabling the bottom to penetrate as far as required into the adjacent subsoil beneath the final position of the platform.

Figure 5:
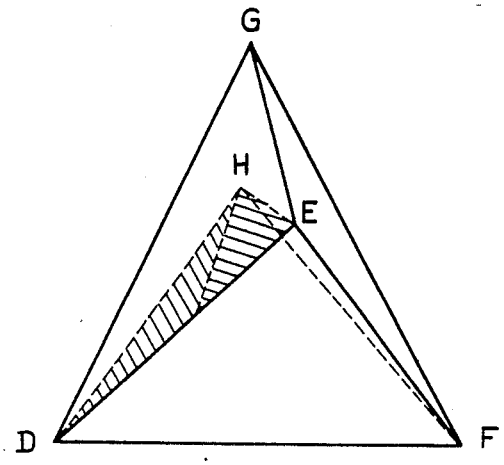
FIG. 5 is a diagram of a bottom pyramid of the base.

FIG. 5 is a perspective view of a pyramid component in one of the lattice tetrahedra.

The pyramid and the tetrahedron have a common base DEF, but the vertex G of the tetrahedron is above the vertex H of the pyramid. To construct the pyramid, it is convenient to have a portion of each face of the pyramid molded integrally with the corresponding node of the lattice. For example, one half of the face DHE should be molded with the node D, while the other half should be molded with the node E.

The two halves are then assembled by any suitable technique, eg. by a technique similar to that used to assemble two arms end-to-end to form a bar.

Thus the pyramids at the bottom of the base are installed at the same time as the nodes which constitute the bottom level of the lattice.

Figure 6:
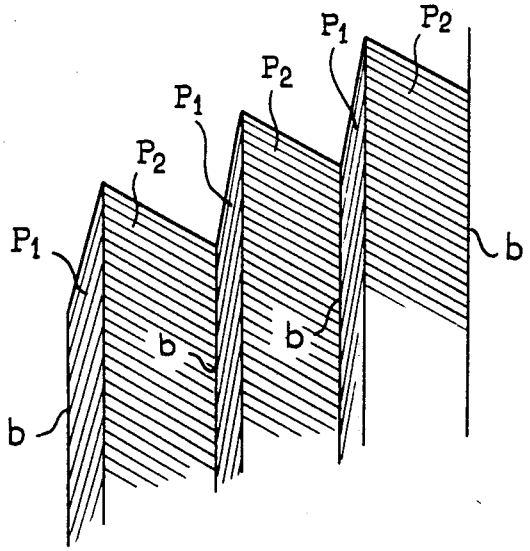
FIG. 6 is a diagram of a portion of the lateral facade of the base.

The facade of the base is preferably a corrugated concrete facade. To make the facade (see FIG. 6), is it convenient to prefabricate elongate concrete troughs each comprising two plane walls P1 and P2 at an angle to each other, and then to fix the troughs to the outside bars of the lattice to build up the facade. It is thus advantageous for the outside bars of the lattice to constitute rectangles extending upwards along the outside face of the lattice with the plane walls P1 and P2 being fixed in watertight manner to the bars b situated along the long sides of the rectangles and so forth from trough to trough.

FIG. 7 to 10 show variant embodiments of the invention.

Figure 7:
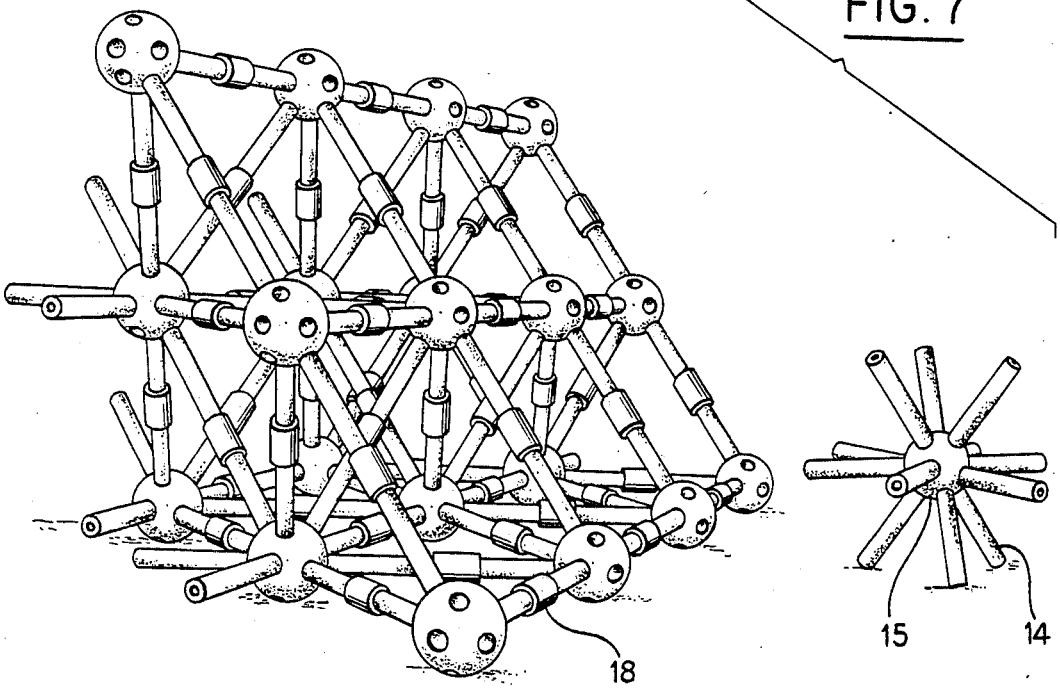
FIG. 7 is a perspective view of another embodiment of a prefabricated block and of a portion of a base built up from such blocks.

In FIG. 7, the molded block is constituted by a central spherical node 15 with cylindrical arms 14 radiating therefrom. To the left of the block there is a portion of assembled lattice built up from similar blocks, and sleeves 18 can be seen on the arms of the blocks in end-to-end pairs to constitute the bars of the lattice.

Figure 8:
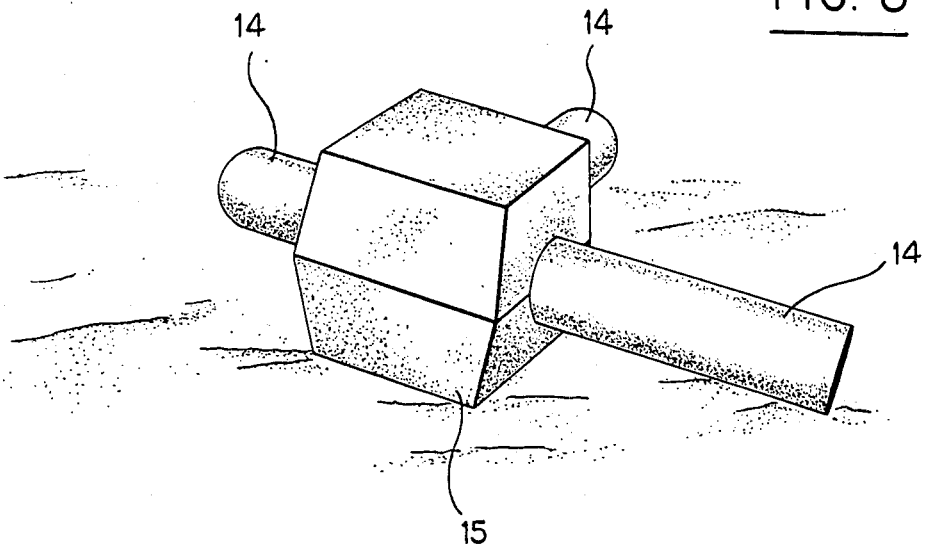

FIG. 8 is a perspective view of another variant of a lattice block.

Figure 9:
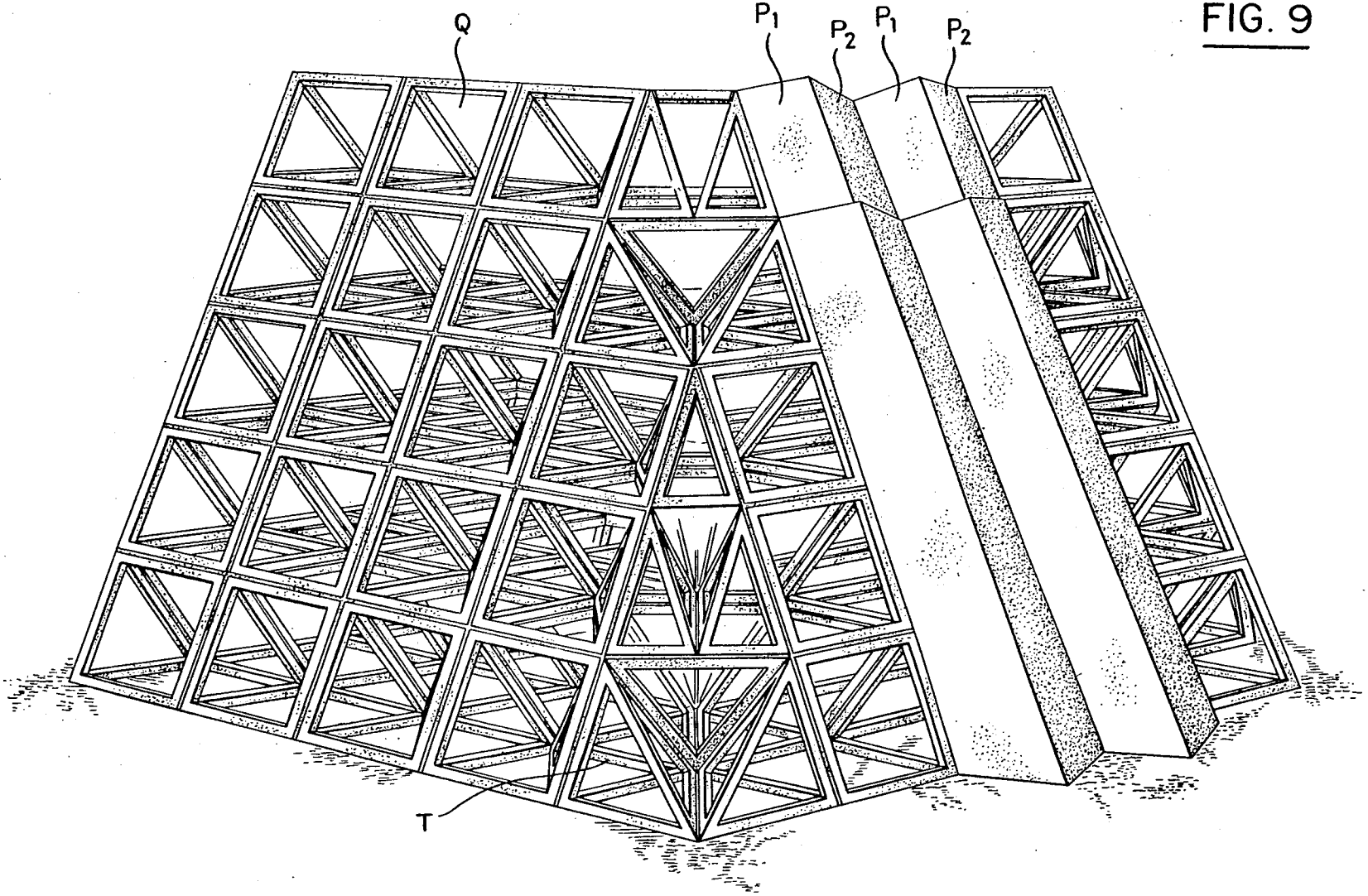
FIG. 9 is a perspective view of a portion of the base in accordance with a variant of the invention and on which a portion of the facade has been shown.
Figure 10:
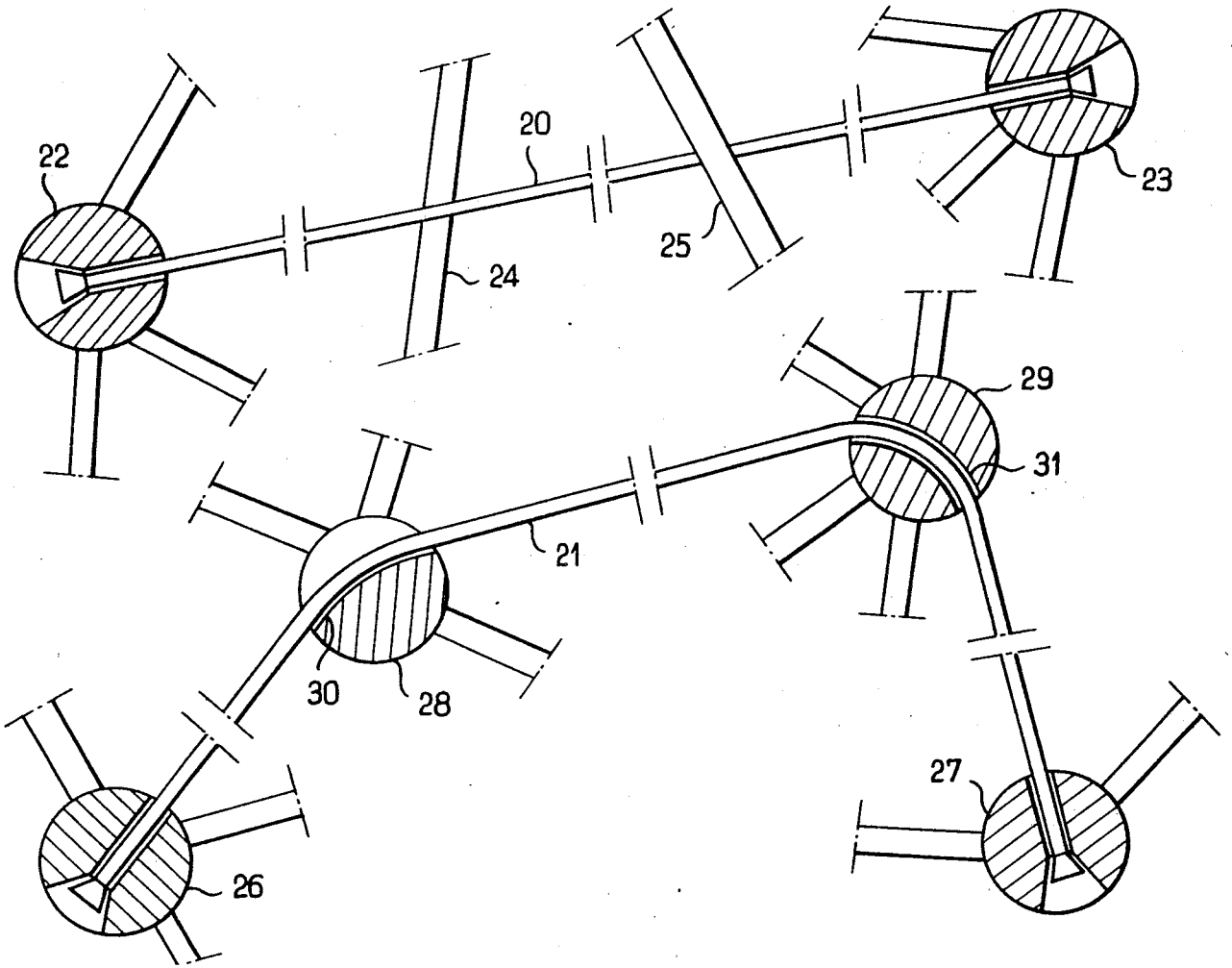
FIG. 10 is a diagram of prestress cables of the base.

FIG. 9 is a perspective view of a portion of a lattice. The bars of the lattice in the planes underlying the facade are disposed along the sides of squares Q and along the sides of triangles T, which may outline trapeziums. These dispositions are not limiting and are given merely by way of example. FIG. 9 also shows a portion of the lateral facade. In this example, the lateral facade is built up from portions of facade that correspond in size to and that are fixed to one of the tetrahedra of the lattice, and the different portions of the facade are successively joined together by mortar or by added on concrete FIG. 10 is a simplified view showing schematically to prestress cables 20,21. Prestress cable 20 is rectilinear and its ends are fixed to two nodes 22,23 of the lattice.

The cable crosses several bars of the lattice such as bars 24 and 25 but remains outside the bars. Prestress cable 21 also is attached at both ends at nodes 26 and 27 of the lattice but the cable is not rectilinear and is deviated by some nodes of the lattice, such as nodes 28 and 29. Node 28 is provided with a groove 30 and node 29 is provided with an internal channel 31 for deviating cable 21. Only a part of the arms of the nodes is shown on the drawing.

The invention is not limited to a specific geometric pattern of the bars but preferably the bars of the lateral faces of the lattice are disposed along the sides of equilateral or isosceles triangles and/or along the sides of rectangles or squares. The latera faces are planes inclined with respect to the vertical, as in the shown embodiment; in other embodiments, the lateral faces are vertical.

The sides and the bottom of the lattice are made watertight by any means but, preferably, the watertightness is obtained by a plurality of concrete walls which are sealingly fixed to or integral with the bars of the lattice which are present in the side faces and in the bottom face of the lattice and preferably the concrete walls which make watertight a side of the lattice are disposed according to a corrugated pattern, which reduces the effect of difference of temperature between the part of the side which is in water and the part of the side which is above water. Such difference of temperature, which in iced seas may be 50° C. or more, might provoke dilatation stresses detrimental to the side walls if the walls were plane.

I claim:

1. A concrete structure comprising: a plurality of prefabricated cast concrete blocks, each block having a node and a plurality of arms radiating outwardly from the node, each of said blocks interconnected with a plurality of others of said blocks at connections between outer free ends of respective ones of said arms to define a rigid, three-dimensional lattice, each arm having at least one longitudinal socket defined by an opening in the free end of the arm, connected arms being joined in pairs in axially aligned relationship to define bars of the lattice, the sockets of assembled arms being in alignment, a metal reinforcing member received in each one of a pair of aligned sockets, the connections of the arms surrounded by a sealing sleeve, said sockets being filled with hardened mortar to securely join the arms to the reinforcing member, and prestress cables passing outside the bars of the lattice and fixed at ends of the cables to nodes of the lattice to prestress the structure.

2. A structure according to claim 1, wherein at least some of the arms have a length that is substantially one half the length of a bar.

3. A structure according to claim 1, wherein the length of the bars is from about 2 m to about 10 m and wherein the cross section of the bars may be inscribed in a circle of from about 20 cm to about 100 cm diameter.

4. A structure according to claim 1, wherein the bars have a length from about 2 m to about 10 m and are of circular cross section and have a diameter of from about 30 cm to about 80 cm.

5. A structure according to claim 1, wherein the sleeves are made of heat shrinkable material.

6. A structure according to claim 1, wherein at least some of the prestress cables pass around nodes offset from a line interconnecting nodes to which the ends of the cables are secured.

7. A structure according to claim 1, wherein at least some of the prestress cables extend linearly between and have their ends secured to each of a pair of spaced nodes.

8. A block of molded concrete for making a structure, said block comprising: a node and a plurality of arms radiating outwardly from the node, each arm having at least one longitudinal socket defining an opening in a free end of the arm, and at least one transversely extending passage in each arm and communicating with said socket for at least one of inserting mortar into the socket and removing air therefrom.

9. A molded concrete block acccording to claim 8, wherein the node includes deviation means for receiving a portion of a cable and for turning the cable through an arc.

10. A molded concrete block according to claim 9, wherein the deviation means is a groove formed in an outer surface of the node.

11. A molded concrete block according to claim 9, wherein the deviation means is an internal channel formed in the node.

* * * * *